US007204342B2

(12) United States Patent
Lee

(10) Patent No.: US 7,204,342 B2
(45) Date of Patent: Apr. 17, 2007

(54) SOUND FOCUS SPEAKER OF GAS-FILLED SOUND LENS ATTACHMENT TYPE

(75) Inventor: Jay-Min Lee, Kyungsangbuk-do (KR)

(73) Assignee: Postech Foundation, Kyungsangbuk-do (KR)

( * ) Notice: Subject to any disclaimer, the term of this patent is extended or adjusted under 35 U.S.C. 154(b) by 360 days.

(21) Appl. No.: 10/511,262

(22) PCT Filed: Apr. 25, 2003

(86) PCT No.: PCT/KR03/00840

§ 371 (c)(1),
(2), (4) Date: Oct. 19, 2004

(87) PCT Pub. No.: WO03/092321

PCT Pub. Date: Nov. 6, 2003

(65) Prior Publication Data

US 2005/0224282 A1 Oct. 13, 2005

(30) Foreign Application Priority Data

Apr. 25, 2002 (KR) ..... 10-2002-0022639

(51) Int. Cl.

| | |
|---|---|
| ***G10K 11/30*** | (2006.01) |
| ***G10K 11/26*** | (2006.01) |
| *G10K 11/36* | (2006.01) |
| *G10K 11/18* | (2006.01) |

(52) U.S. Cl. ..... 181/176; 181/175

(58) Field of Classification Search ..... 181/176, 181/175; 367/103, 150

See application file for complete search history.

(56) References Cited

U.S. PATENT DOCUMENTS

| | | | | | |
|---|---|---|---|---|---|
| 1,895,442 | A | * | 1/1933 | Bowker | 369/158 |
| 2,216,949 | A | * | 10/1940 | Kellogg | 181/148 |
| 3,451,296 | A | * | 6/1969 | Alexander, Jr. | 83/13 |
| 3,754,208 | A | * | 8/1973 | Eilers | 367/150 |
| 3,778,562 | A | * | 12/1973 | Wright | 381/335 |
| 3,825,887 | A | * | 7/1974 | Murry | 367/191 |
| RE32,062 | E | * | 1/1986 | Samodovitz | 73/642 |
| 4,779,241 | A | * | 10/1988 | Atalar et al. | 367/104 |
| 4,967,873 | A | * | 11/1990 | Hacchow et al. | 181/176 |
| 5,305,731 | A | | 4/1994 | Buchholtz | 601/4 |
| 5,365,024 | A | | 11/1994 | Hasegawa et al. | 181/176 |

FOREIGN PATENT DOCUMENTS

| | | | | |
|---|---|---|---|---|
| JP | 4-324797 | A | | 11/1992 |
| JP | 05134688 | A | * | 5/1993 |
| JP | 8-223695 | A | | 8/1996 |
| JP | 2006013903 | A | * | 1/2006 |

* cited by examiner

*Primary Examiner*—Edgardo San Martin
(74) *Attorney, Agent, or Firm*—Bacon & Thomas PLLC

(57) ABSTRACT

A sound focus speaker adopting a gas-filled sound lens enhances efficiency of transferring sound from a source to target area and of protecting a spread of transferred sound. The sound focus speaker includes a gas-filled sound lens, sound sources for generating sound and a sound-absorption room for surrounding the sound lens and the sound sources. Sound emitted from the sound focus speaker is focused at specific distance to make a focus point and not spread to the outer of the focus point from forming a sound area.

7 Claims, 2 Drawing Sheets

SOUND FOCUS SPEAKER OF GAS-FILLED SOUND LENS ATTACHMENT TYPE

TECHNICAL FIELD

The present invention relates to a sound focus speaker; and, more particularly, to a sound focus speaker having gas-filled sound lens for focusing sound in an audio frequency band.

BACKGROUND ART

A sound wave is a kind of wave, and therefore the sound wave is refracted to a different direction of propagation while passing through a different medium. Recently, in the field of ultrasonic wave, an active research has been in progress in focusing sound by forming a micro focal point at a specific distance from the ultrasonic source. However, it is not technically easy to focus sound in an audible frequency band due to diffusing characteristics of sound wave in a wave projecting direction. Though a conventional sound focus system including a sound reflector can be implemented rather theoretically, the component of the system is heavy weight and a rich sound quality cannot be guaranteed.

Further, due to the wave characteristic of the sound wave, the sound waves interfere with one another. Therefore, at a practical circumstance, a sound level heard by a listener is substantially attenuated. And the emitted sound wave may cause a background noise because the sound wave is spread to a certain peripheral area.

By using a refraction of sound wave, a speaker for focusing a sound to a focal point and reducing its spreading to an outskirt of the focal point is required.

DISCLOSURE OF INVENTION

It is, therefore, an object of the present invention to provide a speaker for focusing a sound by using a sound wave characteristic in which the direction of a sound wave converges to a focal point.

In accordance with the present invention, there is provided a speaker for focusing sound in audible frequency to a focal point, including, a sound lens filled with a gas heavier than air; sound source generators coupled with the sound lens in concentric axis; and a soundproof chamber for surrounding the sound lens and the sound source generators.

BRIEF DESCRIPTION OF DRAWINGS

The above and other objects and features of the present invention will become apparent from the following description given in conjunction with the accompanying drawings, in which.

BEST MODE FOR CARRYING OUT THE INVENTION

A preferred embodiment of a sound focus speaker in accordance with the present invention will now be described with reference to the accompanying drawings.

Figure 1:
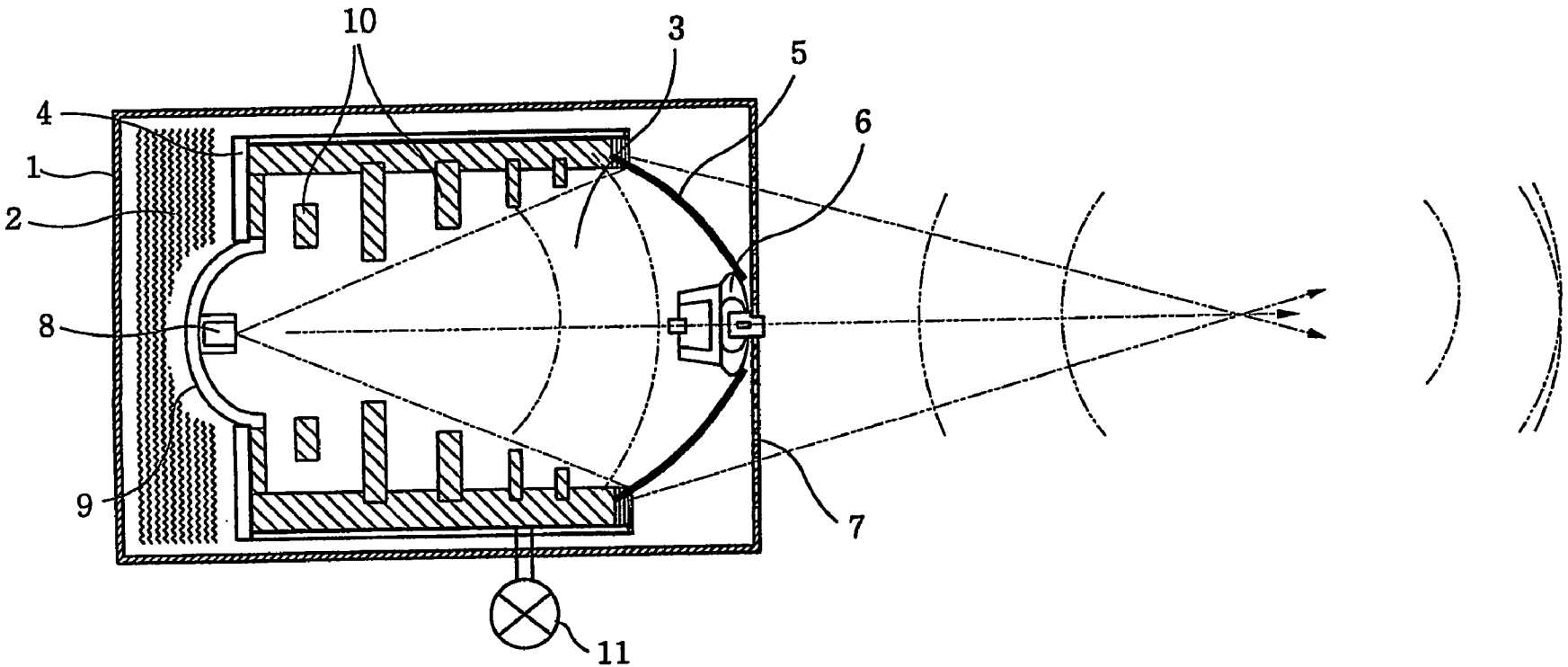
FIG. 1 illustrates a sound focus speaker including a gas-filled sound lens.

FIG. 1 describes a side sectional view of the sound focus speaker in accordance with the present invention. The sound focus speaker includes a soundproof chamber 1, a sound absorbing material 2, a gas-filled sound lens 3, a rear lens membrane 4, a front lens membrane 5, a vertex vibration absorbing structure 6, a center fixing connector 7, a high pitch sound source vibrator 8, a low pitch sound source vibrator 9 and sound absorbing plates 10, and optionally further includes a gas pressure control unit 11.

The soundproof chamber 1 is a part of a speaker sound chamber and an inner wall thereof is made with sound absorbing material. And also, the gas-filled sound lens 3 and the sound source generators 8, 9 are installed in the soundproof chamber 1. The sound absorbing material 2 in the soundproof chamber 1 is arranged to minimize noise and a wave distortion and especially is designed to absorb a low pitch sound from the low pitch sound source vibrator 9 for preventing any unnecessary vibration.

The sound source generators 8, 9 have a high pitch sound source vibrator 8 and a low pitch sound source vibrator 9. The high pitch sound source generator 8 is arranged on the central axis of the soundproof chamber 1 considering rotational symmetry of the soundproof chamber 1 and the low pitch sound source vibrator 9 is arranged on circumference of a concentric circle with the high pitch sound source vibrator 8, separately. Since an off-axis arrangement of the sound source deteriorates sound focusing, only the low pitch sound source vibrator 9, which generates a long wavelength, may use an off-axis sound source. Further, as the power of the low pitch sound is increased, an overtone vibration is induced at the exterior lens surface and it deteriorates the refraction of sound wave. Therefore, the axial alignment between the high pitch sound source vibrator 8 and the low pitch sound source vibrator 9 is preferred to be in symmetrical layout.

The gas-filled sound lens 3 is filled with gas being heavier than air from the rear lens membrane 4 to the front lens membrane 5. The front lens membrane 5 is to be a border of the sound lens 3 where the sound is refracted. The filled gas induces elastic tension along the surface of the front lens membrane 5 at a certain inner pressure slightly above the atmospheres pressure. The degree of sound focusing depends on the dynamics of elasticity imposed on the front lens membrane 5. Sound refraction is synergistic with a penetrability and directionality of the sound wave and therefore it mainly depends on an elasticity of the membrane and an incident angle of the sound wave. Further, the refraction of sound wave on the border of lens has great dependency on a type of material of lens membrane.

And also, in order to maximize the sound focus efficiency, the convex border 5 of the sound lens 3 should be implemented with a proper geometrical figure according to the density of filled gas in the sound lens 3. Generally, when relatively light gas such as $CO_2$ rather than heavy gas, i.e. Kr, is used for an inner filled gas, greater convexity of the border 5 should be applied to achieve an efficient sound focusing, because a speed of sound wave in $CO_2$ is about 20% slower than in the air and is slower about 42% in Kr than in the air. Therefore, in a case that Kr is used for inner filled gas, a converging angle of the sound wave can be increased to have several times the efficiency of sound focusing than in a case of when $CO_2$ is used and moreover, a higher limit of inward sound pressure at which the inner filled gas can endure in the sound lens 3 is attained. And further, selecting a proper definition of incident angle for enhancing sound permeability through the membrane is facilitated.

The high pitch sound source vibrator 8 positioned at specific location in the sound lens 3 generates a sound wave.

The sound wave from the high pitch sound source vibrator 8 is refracted while passing through the front lens membrane 5 to thereby be focused at a certain exterior position. Due to the rotational symmetry of surface of the front lens membrane 5, the sound wave propagation is concentrically made along the convex surface of the front lens membrane 5. Concurrently, however, the excessive concentration of sound pressure may induce an overtone vibration on the membrane. The vibration absorbing structure 6 is installed on the apex of the convex surface of the membrane for preventing the overtone vibration induced on the convex surface of the membrane. And the central fixing connector 7 is installed for supporting the vertex vibration absorbing structure 6.

In the sound lens 3, the absorbing plates 10 are arranged to reduce efficiently a vibration induced by sound increment. The absorbing plates 10 are attached in layers at the inner wall of the sound lens 3 for preventing unnecessary resonance and absorbing a type of noises in the sound lens 3. And, the positions and interrelation of every component in the sound lens 3 influences the eccentricity of the sound. For example, by controlling a declination of the attached absorbing plates 10 against the inner wall of the sound lens 3, it is possible to control an incident angle toward the border 5 of the lens 3.

Moreover, in order to stabilize the pressure and temperature of the inner filled gas as time elapses, an intelligent gas pressure control unit 11 is optionally installed on the sound lens 3.

Figure 2:
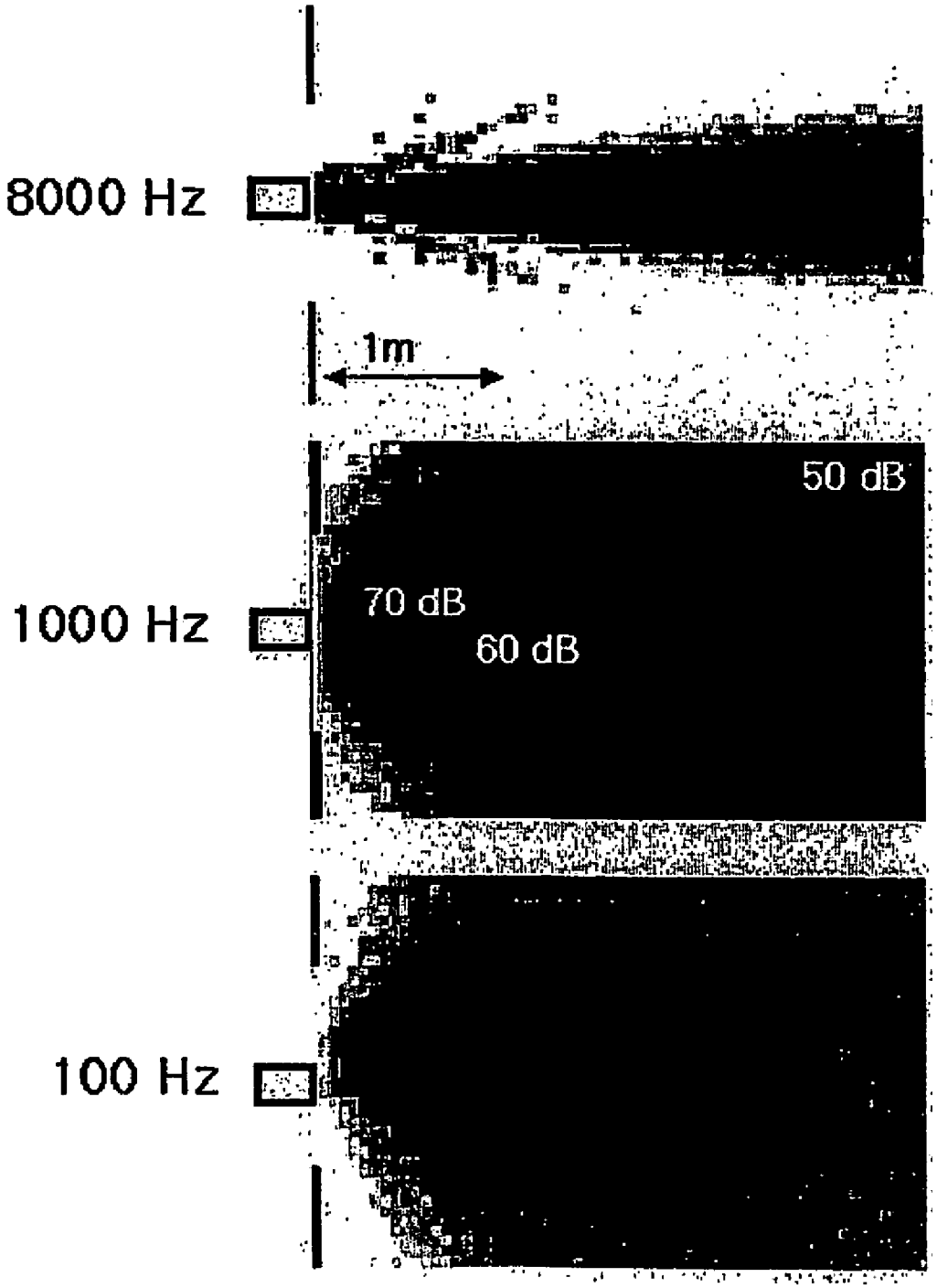
FIG. 2 depicts a degree of sound focusing based on sound wave frequency for the sound focus speaker in accordance with the present invention.

FIG. 2 shows a degree of refraction according to the sound wave frequency bandwidth. In high frequency over 2000 Hz, the sound wave has short wavelength and all refracted waves converge to a well-focused zone effectively. In medium frequency band between 350 Hz and 2000 Hz, the sound wave has middle wavelength and the effect of the sound refraction and focusing formation is attenuated. In low frequency band between 80 Hz and 350 Hz, the sound wave has long wavelength and the sound focusing effect is minimized. That is, in the range of audible sound frequency over 350 Hz, the sound focusing is accomplished effectively.

In accordance with the present invention, when the transferring efficiency of sound wave is designed to be maximized, the sound transferred to a fixed target area of focus is over 90% of the sound generated from the sound source in the high frequency band; 20~90% in the middle frequency band; and at least 20% even in the low frequency band. This translates to the sound focus speaker in accordance with the present invention generating a noise background level 10 times lower in 2000 Hz and 5 times lower in 800 Hz compared to the conventional loudspeaker.

Consequently, high quality of the sound can be transferred in a noisy surrounding and a prevention of sound spreading out of a focal point is accomplished. Therefore, the sound-focusing speaker in accordance with the present invention can be used in a low noise sound system and home electronics, such as a television speaker and a computer speaker. And also, the speaker of the present invention can be used for various sizes and types of sound systems because an audible distance can be elongated and the size of speaker can be extended according to the location and operating environment.

While the present invention has been described with respect to certain preferred embodiments only, other modifications and variations may be made without departing from the spirit and scope of the present invention as set forth in the following claims.

The invention claimed is:

1. A speaker for focusing sound in audible frequency to a focal point, comprising, a sound lens filled with a gas heavier than air;

sound source generators coupled with the sound lens in concentric axis; and a soundproof chamber for surrounding the sound lens and the sound source generators.

2. The speaker of claim 1, wherein the sound lens includes a sound absorbing material for preventing sound from spreading and reflecting to unnecessary direction for sound focusing;

a convex border membrane for refracting sound wave;

a vertex vibration absorbing structure for attenuating an overtone vibration of the border membrane; and a center fixing connector for supporting the vertex vibration absorbing structure.

3. The speaker of claim 1, wherein the sound source generator includes a high pitch sound source vibrator and a low pitch sound source vibrator, which are separated from each other.

4. The speaker of claim 3, wherein the high pitch sound source vibrator is positioned at central area and the low pitch sound source vibrator is positioned at concentric circumferential area of the high pitch sound source vibrator.

5. The speaker of claim 2, wherein the sound absorbing material is attached in layers at an inner wall of the sound lens.

6. The speaker of claim 1, wherein the inner gas filled in the sound lens is $CO_2$ or Kr.

7. The speaker of claim 1, wherein the sound lens further includes a gas pressure control unit for controlling the pressure of a gas that is filled in the sound lens.

* * * * *